United States Patent [19]

French

[11] 4,434,908

[45] Mar. 6, 1984

[54] CONTAINER HAVING INTEGRAL OPENING MEANS

[75] Inventor: William L. French, Hillsboro, Ohio

[73] Assignee: Buckeye Molding Company, New Vienna, Ohio

[21] Appl. No.: 487,599

[22] Filed: Apr. 29, 1983

Related U.S. Application Data

[63] Continuation of Ser. No. 273,333, Jun. 15, 1981, abandoned.

[51] Int. Cl.[3] ..... B65D 17/40; B65D 17/34

[52] U.S. Cl. ..... 220/276; 220/270

[58] Field of Search ..... 220/270, 276; 215/254, 215/256; 150/0.5; 229/43 R

[56] References Cited

U.S. PATENT DOCUMENTS

| | | | |
|---|---|---|---|
| 3,034,680 | 5/1962 | Steinberg | 220/27 |
| 3,281,007 | 10/1966 | Dorosz | 220/54 |
| 3,303,962 | 2/1967 | Lake | 220/54 |
| 3,334,777 | 8/1967 | Smyth | 220/54 |
| 3,407,957 | 10/1968 | Robinson | 215/42 |
| 3,415,404 | 12/1968 | Robinson | 215/46 |
| 3,415,412 | 12/1968 | Robinson et al. | 220/54 |
| 3,773,209 | 11/1973 | Schane | 220/54 |
| 3,981,412 | 9/1976 | Asmus | 220/276 |
| 4,030,630 | 6/1977 | Yealy | 220/258 |
| 4,087,018 | 5/1978 | Tebbutt | 220/257 |
| 4,171,062 | 10/1979 | Allen | 220/270 |
| 4,190,175 | 2/1980 | Allen | 220/276 |
| 4,211,336 | 7/1980 | Helms | 220/270 |
| 4,212,409 | 7/1980 | Jeppson | 220/276 |
| 4,324,342 | 4/1982 | Yamaguchi et al. | 220/270 |
| 4,380,303 | 3/1983 | Allen | 220/276 |

*Primary Examiner*—George T. Hall

*Attorney, Agent, or Firm*—Roger S. Dybvig

[57] ABSTRACT

A one-piece container blank including an easy-open end is provided with a pull tab, the free end of which may be raised upwardly to initiate tearing of a ribbon of plastic from a sloping side wall of the end closure. The tearing is initiated along a sloping line generally underneath the pull tab and a vertical line substantially aligned with, and of the same length as, the edge of the pull tab at the leading end of the ribbon. A continuing lifting or pulling away of the pull tab from the container body will result in complete removal of the end closure from the container body.

15 Claims, 4 Drawing Figures

FIG-1
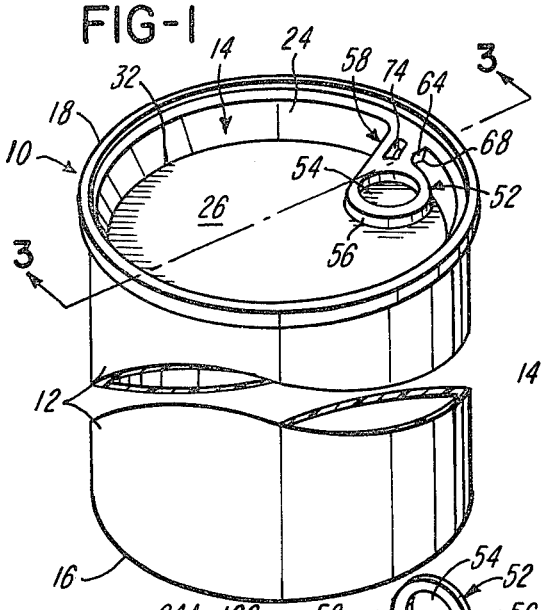
FIG-2
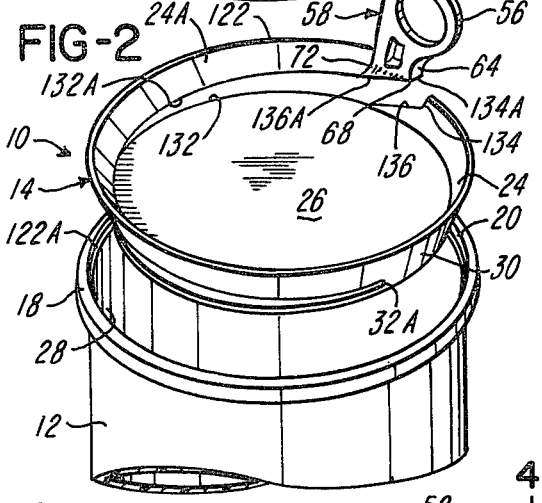
FIG-4
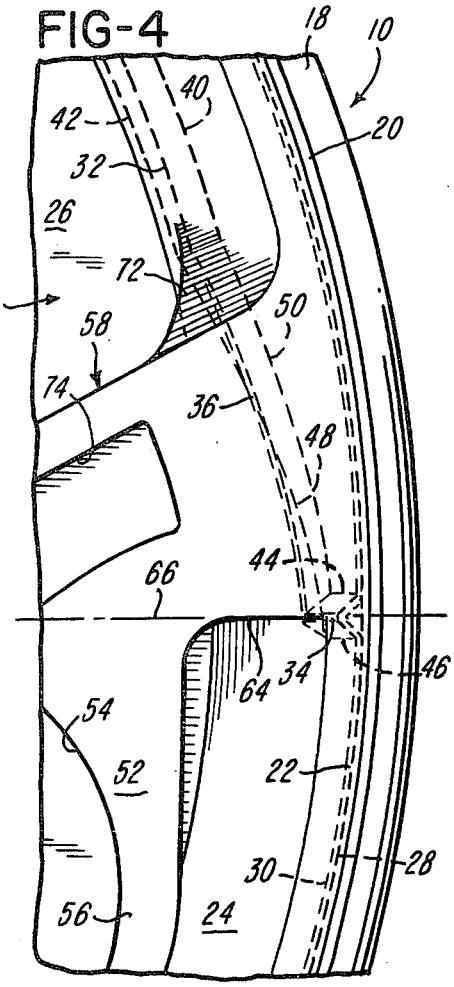
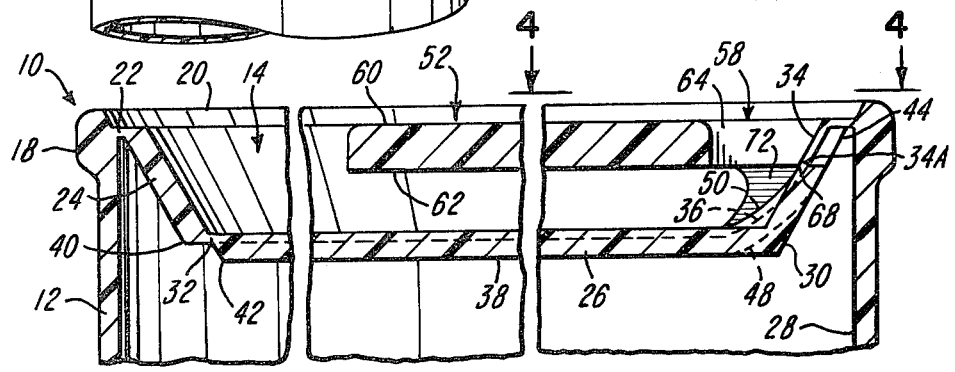
FIG-3

CONTAINER HAVING INTEGRAL OPENING MEANS

This application is a continuation of application Ser. No. 06/273,333, filed June 15, 1981 now abandoned.

BRIEF SUMMARY OF THE INVENTION

This invention relates to a container structure and more particularly to a plastic container blank comprising a container body and an easy-open end member of the type that is removed in its entirety from the container by the rupturing of a weakened line or score extending completely around the end member. An end closure of this type may be referred to as a "full panel pullout" and is intended to be molded in one piece with the container. It is removed from the container by manual engagement of a pull tab or the like which is pulled or pushed to initiate the rupture of the score, the pull tab being removed along with the remainder of the end closure.

Although the present invention is intended primarily for use in a construction wherein the container body and the end closure are molded in one piece, those familiar with the art will recognize that the invention may also be applicable to constructions wherein the end closure is molded on or otherwise connected to a separately formed container body.

The provision of a one piece plastic easy-open closure of the type described above has proved to be a difficult task. Especially, it has been difficult when using plastic formulations that are sufficiently rigid to produce acceptable containers to provide such a closure that may be easily used by the general public and will be reliable in the sense that the pull tab and other parts of the end closure used to initiate the separation of the closure from the container will dependably remain unbroken. In the copending application of David O. Allen and Harry A. E. Wombold, Ser. No. 205,429, filed Nov. 10, 1980 now U.S. Pat. No. 4,380,303, granted Apr. 19, 1983, which is assigned to the assignee of the instant application, a container is disclosed having an end closure member which is connected to the container by a circular weakened line extending completely therearound. The end closure member comprises a panel recessed within the container body below the circular weakened line and having a sloping side wall extending completely around the panel, the upper and outer end of which is directly connected to the weakened line. A second weakened line extends approximately 300 degrees along the sloping wall in concentric relation to the first mentioned weakened line and is connected to the first mentioned weakened line by a transverse or vertical score line that extends along the sloping wall between the two concentric weakened lines. A pull tab including a ring connected to the sloping wall by a spoke extending along the vertical score and spanning between the two concentric score lines is further connected by a flange extending alongside the spoke which provides a type of lever arm so that one may engage the pull ring and, by pulling it sideways, create a substantial tensive force along the vertical score to initiate a rupture of the weakened sections. Containers constructed in accordance with the disclosure of said application Ser. No. 205,429 were made from high-density polyethelene. Although the manner of removal of the end closure was usable by those familiar with the direction in which the pull ring was to be pulled to create the lever action, the portion of the narrow strip between the two weakened lines would often break away before the closure was fully removed. More significantly, it was found that the pull ring would easily break off if one lifted the ring rather than moved it sideways, such breaking of the ring typically occurring before rupture of the vertical score. The general public, having become accustomed to lifting pull rings when removing easy-opening metal ends, would therefore be very likely to find such a construction unsatisfactory. Efforts have been made to overcome these problems by forming the scores further apart so that the ribbon of material initially removed would be less likely to break. This also provided space to include stiffening ribs or fillets at the point of connection of the pull tab to the sloping wall. However, recent tests have indicated that even with such construction, the pull tabs could not be reliably used to create rupture by lifting up on the rings and in a substantial number (approximately 40%) of the containers tested, the pull tabs would be broken away so that the easy-opening feature would be lost completely.

In accordance with this invention, a moldable one-piece closure construction for a container which may be molded in one piece therewith comprises a center panel surrounded by a sloping side wall which in turn is surrounded by a first weakened line in the form of a web or score which connects it to the container body. A second weakened line separates portions of the end closure and is located entirely within the margins of the closure. The second line is arcuate and has spaced apart ends. One end of a third weakened line extends perpendicularly from the first line along the closure side wall and a fourth weakened line extends from the opposite end of the third line to one end of the second line. The fourth line is connected to both the second line and the third line at obtuse included angles. Removal of the end closure is accomplished by manual engagement of a pull tab that includes a finger ring portion which is lifted to initiate removal of the end closure and then is continued to be lifted to completely remove the end closure with a high degree of reliability. The pull tab comprises a plate-like body connected along the top margin of the sloping side wall, one edge of the plate-like body portion being aligned with the third weakened line. The length of the third line is substantially the same as the thickness of the pull tab, and one edge surface of the plate-like body with the third line with one corner of the pull tab being aligned with the point of juncture of the third line and the fourth line. Accordingly, an upward pull on the pull tab initiates rupture of the closure at or near the junction of the third and fourth lines. A continued upward pull on the pull tab causes the entire fourth line to be torn, then the third line. Thereafter the first and second lines are torn. When the second line is torn along its entire length, a ribbon of plastic formed between the first line and the second line extends between the pull tab and the remainder of the end closure. Continued pulling of the pull tab ultimately results in the tearing of the first line along its entire length and accordingly, removal of the end closure from the container body.

That the length of the third line is substantially equal to the thickness of the pull tab is deemed advantageous to minimize the stress needed to tear the third line and to maximize the tension applied to the third line when the pull tab is raised. The obtuse angular relationship between the third and fourth weakened lines serves to minimize the force that is required to tear open the connection between the first and second lines. Also the obtuse angle of the fourth line relative to the third line provides space beneath the pull tab (except where it is aligned with the third line) for a fillet or a rib to strengthen the connection between the pull tab and the closure side wall. The entire container blank can be injection molded using known techniques.

It is thereby seen that the primary object of this invention is to provide a full panel pullout-type of end closure that may be molded from various different plastic materials and can be easily and reliably removed from a container body by exerting an upward pull on a pull tab forming part of the end closure. Another object is to provide a one-piece container blank that includes such an end closure and a container body.

Other objects and advantages will become apparent from the following descriptions.

BRIEF DESCRIPTION OF THE DRAWINGS

In the drawing:

FIG. 1 is a perspective view of a container blank having its upper end closed by an easy-open closure means, constructed in accordance with present invention, a central portion of the container blank having been broken away.

FIG. 2 is an exploded perspective view of the container blank of FIG. 1 with the lower portion of the blank broken away and with the easy-open container closure means having been separated from the body of the container blank.

FIG. 3 is an enlarged section view taken along lines 3—3 of FIG. 1 with portions broken away.

FIG. 4 is an enlarged framentary plan view of portions of the container blank indicated by arrows 4—4 of FIG. 3.

DESCRIPTION OF THE PREFERRED EMBODIMENT

FIGS. 1 through 4 illustrate a one-piece container blank 10 molded so as to have a tubular body 12 in the form of a right cylinder and an integrally formed, easy-open end closure 14 closing the upper end of the body 12.

The lower end 18 of the container body 12 is open and suitably formed for attachment of a bottom end panel (not shown) of any desired type. The type and design of the bottom end panel and its method of attachment to the container body are not material to the present invention. The wall of the container body 12 may have a substantially uniform thickness throughout its length and, in the embodiment illustrated herein, is provided at its upper end with a circular thickened chime 18. The upper end of the chime 18 can be seen to have an inwardly sloping interior wall 20 integrally connected to the end closure 14 by means of a first relatively thin and thus weakened line 22 of plastic in the form of a thin web which extends circularly around the end closure 14.

The easy-open end closure 14 comprises a circular, sloping or downwardly convergent side wall 24 in the form of a truncated cone surrounding an integrally formed, circular, disc-like planar bottom or center panel 26. The uppermost and outermost edge of the sloping side wall 24 abuts the first weakened web or line 22 and the top surface of the sloping side wall 24 is coplanar with the top surface of the first line 22. In FIG. 4 it will be noted that the first line 22 is illustrated as bounded by two dash lines that represent, respectively, the inside wall surface, designated 28, of the container body 12 and the outer surface, designated 30, of the sloping closure side wall 24. The first line 22 extends completely around the closure member 14 so that, as apparent from FIG. 2, the entire closure member 14 may be removed from the container body 12 by tearing of the first line or web 22.

In addition to the first weakened line 22, the container blank 10 is provided with an arcuate, second weakened line 32 extending through an angle of approximately 270° along the junction of the closure side wall 24 and the closure center panel 26 in concentric relation, as viewed in plan, to the first weakened line 22. A straight, third weakened line 34 extends part way along the sloping closure side wall 24 in the vertical direction, i.e. in the direction of the length of the container blank 10. As may be seen from an inspection of FIGS. 3 and 4, the third line 34 joins the first weakened line 22 at the top of the side wall 24 and extends transversely jor perpendicularly to the first line 22 downwardly along the upper portion of the side wall 24.

A fourth weakened line 36 joins to the bottom of the third line 34 and extends both axially and circumferentially of the sloping side wall 24 from the bottom of the third line 34 to the start end of the second line 32 for reasons which will be described below. The fourth line 36 joins the third line 34 at an included angle, as viewed along the line of sight perpendicular to the side wall 24, which is an obtuse included angle. An obtuse included angle is also formed at the juncture between the fourth line 36 and the second line 32.

The second, third, and fourth weakened lines of plastic 32, 34, and 36 are desirably formed as narrow, thin walled webs by the provision of elongate, triangularly shaped surfaces formed. Because of the triangular configuration of the machined mold surfaces, the second web or weakened line 32 is shown as the apex of a triangular area in the sectional view, FIG. 3, bounded by edges 40 and 42. The third line 34 is similarly shown bounded by edges 44 and 46, and the fourth line 36 is shown bounded by edges 48 and 50. The third and fourth weakened lines 34 and 36 are shown by double dash lines because they preferably are formed by flats rather than sharp edges. Although not so illustrated, the apex of the triangle forming the second weakened line 32 is preferably also flattened somewhat. The reason for such preference is to reduce erosion of these edges on the mold tooling that would occur when the molten plastic is first injected past such edges to form a container.

The triangular machined mold surfaces (not shown) that form the circular first line 22, the concentric second line 32, and the straight, vertical third line 34 are each substantially uniform in cross section along their entire lengths. Because the triangular mold surfaces forming the fourth, sloping line 36 join at one end to the third vertical line 34 and at the other end to the arcuate second line 32, the cross sectional configuration of the triangular mold surface (not shown) for the fourth line 36 changes along its length, giving it a twisted appearance as will be understood by those familiar with the art.

A plate-like pull tab 52 comprising a free end portion apertured at 54 to form a finger ring 56 and having a foot portion 58 connected to the sloping side wall 24 is provided to enable the tearing away of the closure member 14. Pull tab 52 has parallel upper and lower surfaces 60 and 62, respectively, separated by its thickness, which is substantially equal to the length of the third or vertical weakened line 34. The pull tab 52 is supported in spaced, parallel relation to closure center panel 26 by connection of the end edge of the foot 58 to the upper end of the sloping side wall 24, the tab 52 being so located that its upper surface 60 is substantially coplanar with the top surface of the side wall 24 and its lower surface is substantially coplanar with the lower end 34A of the third weakened line 34. The side edge, designated 64, of the foot portion 58 which is farthest clockwise as viewed in FIGS. 1, 2 and 4, lies along a centerline, designated 66, of the container blank 10, which centerline intersects the third vertical line 34. Accordingly, the lower corner 68 of the pull tab 52, which corner 68 joins to the sloping side wall 24 where it is intersected by the container blank centerline 66, is substantially aligned with the point of juncture of the third and fourth weakened lines 34 and 36.

As may be appreciated from a consideration of the foregoing, an upward pull on the finger ring 56 from the relaxed, as molded position thereof illustrated in FIG. 1, will cause a pivotal movement of the pull tab foot 58 that will apply a substantial tensive force at the junction of the third and fourth weakened lines 34 and 36 with the result that one or both of these weakened lines is ruptured. In practice it is found that the fourth weakened line 36 often is the first to rupture and will tear along its entire length, the third weakened line 34 then tearing completely. By continuing to lift the pull tab away from the container body 12, the first and second weakened lines 22 and 32 are then torn whereupon a ribbon of plastic 24A is torn from the side wall 24. This ribbon terminates at the end of the second weakened line 32 remote from the fourth line 36 at a point, designated 32A in FIG. 2. Continued lifting of the pull tab 32 then causes the end closure 14 to be completely torn away from the container body 12.

Considering the point of intersection of the third and fourth weakened lines 34 and 36 as a starting point, it may be observed that the pull tab foot 58 extends in a counterclockwise direction from such point, as viewed in plan, as does the fourth line 36. Because the included angle between the fourth line 36 and the third line 32 is obtuse, the fourth line 36 slopes downwardly in a counterclockwise direction beneath the pull tab foot 58 which thereby provides space for a fillet 72 beneath a substantial portion of foot 58 and above the fourth line 36 to strengthen the connection of the pull tab 52 to the sloping side wall 24. As shown in FIG. 4, the fillet 72 also extends counterclockwise of the tab foot 58 and blends into the adjacent side wall 24. Also the obtuse included angles between the fourth line 36 and both of the second and third lines 32 and 34 reduces the force that must be used to cause tearing along the points of joinder of such weakened lines.

An aperture 74 may be located in the pull tab 52 to reduce the mass of plastic in that area to render it easier to mold.

With reference to FIG. 2, the edges formed by tearing along the weakened lines are labeled to assure complete understanding. Thus, the entire end closure 14 is separated from the container body 12 along the circular outermost and uppermost marginal edge 122 of the sloping wall 24, the circular marginal edge 122 having been formed by tearing of the first line or web 22. A corresponding circular edge or bead 122A, which may contain remnant portions of the first weakened line 22 is located in the top of the container blank 12. The lower edge 132A of the ribbon 24A is formed by tearing of the arcuate second weakened line 32, exposing a circular edge portion 132 of the center panel 26. A vertical edge 134 formed by tearing of the vertical third line 34 is located in the upper edge of the side wall 24 at the end of the portion thereof left connected to the center panel 26, the edge 134A at the free end of the pull tab 52 having been torn away therefrom. Tearing of the fourth weakened line 36 leaves the side wall 24 with an end edge 136 sloping downwardly from the lower end of the vertical edge 134A to the leading end of the circular edge portion 132 of the center panel 36. By virtue of the relationship of the various edges, it may be noted that the ribbon of plastic 24A that is first torn away effectively starts with the pull tab edge 134A and that the width of this ribbon increases, due to the divergence of the sloping edge 136A from the top edge 122, until the ribbon reaches its maximum width which, in the illustrated case, is the same as the width of the side wall 24. Because of the divergence of the first line 22 and the fourth line 36, the force required to initiate the tearing away of the ribbon 24A is minimal. This divergence and also the location of the pull tab foot 58 and the fillet 72 at the narrowest end of the ribbon substantially precludes the possibility that the narrow end of the ribbon will break off when the end closure 14 is being torn away from the container body 12.

As previously noted, there is an obtuse included angle between the third, vertical weakened line 34 and the fourth, sloping line 36. Any obtuse angle at this juncture is deemed preferable to any other possible included angle. An included angle greater than approximately 100° is preferred. Any obtuse included angle between the fourth weakened line 36 and the second weakened line 32 is also preferred to any other possible angle that would not be obtuse. The latter included angle is preferably greater than approximately 160° to minimize the stress created at this juncture as the tearing of the plastic extends from the fourth line 36 to the second line 32.

The invention described herein may be practiced with a large number of thermoplastic materials such as polyethelene, polystyrene, and polyvinyl chloride. The presently preferred material is high density polyethelene because it is easily molded to form container blanks that have a self-supporting shape. High density polyethelene also has other desirable characteristics, such as relatively low moisture vapor transmission, rendering it desirable for use in packaging food products such as powdered beverages.

Other full panel pullout type end closure designs may be useful with less rigid materials, such as low density polyethelene, such as the closures shown in U.S. Pat. No. 3,415,404 granted Dec. 10, 1968, to W. H. Robinson et al., and U.S. Pat. No. 3,415,412 granted to W. H. Robinson on Dec. 10, 1968. However, the invention described herein may be advantageously used with such less rigid materials.

This invention may be used to produce containers of various different sizes. As an example, not to be taken as limiting of the scope of this invention, prototype blanks embodying the invention to form cans known in the industry as 401×603 cans and molded from high density polyethelene have been produced wherein the diameter of the chime 18 is approximately 4.08", the diameter of the tubular body 12 is approximately 4.02", and the thickness of the walls of the body 12 and the end closure 14 range from approximately 0.045" to 0.055", except for the narrow webs forming the several weakened lines which are approximately 8 mills thick.

The surface of the side walls 24 lie at a 30° angle relative to the inside wall of the container and the central panel 26 is recessed approximately 0.250" from the first weakened line 22. The foot of the pull tab extends through an angle, as viewed in plan, of approximately 15° and has a thickness of approximately 0.100". The sloping, fourth line 36 and the corresponding sloping edge 136 lie at an angle of approximately 17° relative to the plane of the center panel 26. Accordingly, the included angle between the third and fourth weakened lines is approximately 107° and the included angle between the second and fourth weakened lines is approximately 163°.

For mold tooling and techniques adaptable to the molding of containers of this invention with modifications that will be readily apparent to those skilled in the art to accommodate the design of the container blank and disclosed herein, the disclosure of FIGS. 11 through 15 of said application Ser. No. 205,429 and the accompanying description beginning at page 21 line 16 and continuing through page 37 line 18 is herewith incorporated by reference herein.

Those familiar with containers and closures will readily recognize that the upper end of the container blank 10 forms a closure assembly comprising the end closure 14 and the upper end of the container body 12. Such end closure assembly could be formed separately and later mounted on, as by glueing, on a separately formed container body (not shown).

Although the presently preferred embodiment of this invention has been described, it will be understood that various changes may be made within the scope of the appended claims.

Having thus described my invention, I claim:

1. A one piece plastic container comprising a tubular container body, an easy-open end closure closing one end of said body, and a first weakened line of plastic extending completely around said end closure and connecting said end closure to said body, said end closure being removable by completely tearing said first weakened line, said end closure comprising a center panel, a sloping side wall surrounding said center panel and spanning the distance axially and diametrically of said body between said center panel and said first weakened line, a second arcuate weakened line of plastic located entirely within the boundry of said end closure and spaced from said first weakened line, said second weakened line having ends terminating in said end closure, a straight third weakened line extending perpendicularly from said first weakened line partway along said sloping side wall in the axial direction of said body, said third line having one end joining said first weakened line, a fourth weakened line extending between the other end of said third weakened line and one end of said second weakened line, said fourth weakened line joining to said other end of said third weakened line at an obtuse included angle, a pull tab connected to said side wall in spaced relation to said center panel said pull tab comprising a plate-like body having a bottom surface confronting a substantially parallel to said center panel and a top surface spaced from said bottom surface, said pull tab having a side edge surface extending along a diameter of said container aligned with said third line and having a height substantially equal to the length of said third line, an adjacent outer edge surface of said pull tab being integrally connected to said sloping wall so that one corner joining said edge surfaces is substantially diametrically aligned with the point of intersection of said third line and said fourth line.

2. The container of claim 1 wherein said second line and said fourth line join at an obtuse included angle.

3. The container of claim 1 wherein said second line connects said center panel to said sloping side wall throughout a substantial portion of the connection therebetween, said fourth line extending axially and circumferentially along said side wall.

4. The container of claim 1 wherein a filet is formed between said bottom surface of said pull tab and said side wall extending generally between said bottom surface and said fourth weakened line.

5. The container of claim 1 wherein said fourth line extends both axially and circumferentially along said side wall.

6. The container of claim 1 wherein said pull tab has a thickness substantially equal to the length of said third line.

7. The container of claim 1 wherein said top surface of said pull tab is coplanar with the top surface of said side wall.

8. The container of claim 1 wherein said pull tab includes a finger-engagable ring portion.

9. The container of claim 1 wherein each of said weakened lines comprises a thin web of plastic.

10. The container of claim 1 wherein said plastic comprises high-density polyethelene.

11. A plastic easy-open end closure assembly comprising a ring-shaped body, an easy-open end closure closing one end of said body, and a first-weakened line of plastic extending completely around said end closure and connecting said end closure to said body, said end closure being removable by completely tearing said first weakened line, said end closure comprising a center panel, a sloping side wall surrounding said center panel and spanning the distance axially and diametrically of said body between said center panel and said first weakened line, a second arcuate weakened line of plastic located entirely within the boundry of said end closure and spaced from said first weakened line, said second weakened line having ends terminating in said end closure, a straight third weakened line extending perpendicularly from said first weakened line partway along said sloping side wall in the axial direction of said body, said third line having one end joining said first weakened line, a fourth weakened line extending between the other end of said third weakened line and one end of said second weakened line, said fourth weakened line joining to said other end of said third weakened line at an obtuse included angle, a pull tab connected to said side wall in spaced relation to said center panel said pull tab comprising a plate-like body having a bottom surface confronting a substantially parallel to said center panel and a top surface spaced from said bottom surface, said pull tab having a side edge surface extending along a diameter of said container aligned with said third line and having a height substantially equal to the length of said third line, an adjacent outer edge surface of said pull tab being integrally connected to said sloping wall so that one corner joining said edge surfaces is substantially diametrically aligned with the point of intersection of said third line and said fourth line.

12. A plastic container blank comprising a tubular container body, an easy-open end closure closing one end of said body, and a first weakened line of plastic extending completely around said end closure and connecting said end closure to said body, said end closure being removable by completely tearing said first weakened line, said end closure including a ribbon bounded by a portion of said first weakened line, an arcuate second weakened line spaced from said first weakened line, said second weakened line having first and second ends, a third weakened line joining and extending at an angle to said first weakened line, and a fourth weakened line extending from the end of said third weakened line remote from said first weakened line to said one end of said second weakened line, said fourth weakened line diverging from its point of juncture with said third weakened line away from said first weakened line, and a pull tab connected to the end of said ribbon adjacent said third weakened line.

13. The container blank of claim 12 wherein a corner of said pull tab connected to said ribbon is substantially aligned with the intersection of said third and said fourth weakened lines.

14. The container of claim 11 wherein said plastic comprises high-density polyethelene.

15. The container of claim 12 wherein said plastic comprises high-density polyethelene.

* * * * *